US005722852A

United States Patent [19]

Miek

[11] Patent Number: 5,722,852

[45] Date of Patent: Mar. 3, 1998

[54] MODULE FOR THE CONNECTION OF ACTUATOR AND/OR SENSORS

[75] Inventor: Wolfgang Miek, Amberg, Germany

[73] Assignee: Siemens Aktiengesellschaft, München, Germany

[21] Appl. No.: 530,314

[22] PCT Filed: Mar. 31, 1994

[86] PCT No.: PCT/EP94/01026

§ 371 Date: Nov. 30, 1995

§ 102(e) Date: Nov. 30, 1995

[87] PCT Pub. No.: WO94/24725

PCT Pub. Date: Oct. 27, 1995

[30] Foreign Application Priority Data

Apr. 14, 1993 [EP] European Pat. Off. ..... 93106060

[51] Int. Cl.[6] ..... H01R 4/24

[52] U.S. Cl. ..... 439/417; 439/404; 439/488

[58] Field of Search ..... 439/404, 405, 439/406, 417, 418, 419, 271, 488, 490

[56] References Cited

U.S. PATENT DOCUMENTS 4,934,953 6/1990 Tenham et al. ..... 439/417
5,211,575 5/1993 Ustin ..... 439/417
5,240,432 8/1993 Daoud ..... 439/417

FOREIGN PATENT DOCUMENTS 0 152 690 8/1985 European Pat. Off. .
0 194 052 9/1986 European Pat. Off. .
0 233 536 8/1987 European Pat. Off. .
0 234 639 9/1987 European Pat. Off. .
2 419 621 11/1974 Germany .

*Primary Examiner*—J. J. Swann
*Attorney, Agent, or Firm*—Kenyon & Kenyon

[57] ABSTRACT

A module is intended to be provided for the purpose of connecting a plurality of subscribers which has a simple structure and by means of which a cable can be made contact with in a simple, cost-effective and reliable manner. To this end, a bottom-part housing (1) is provided with a contact-making device which essentially comprises a guiding part (7), a line basket (9) and contacts (6) in the form of strips with contact tips (11). The line basket (9) can be latched in two vertical positions in the guiding part (7). The cable (5) provided with a form coding can be inserted in the line basket (9) in the upper preassembly position. When the line basket (9) is displaced into the lower position, the insulation of the cable (5) is penetrated by the contact tips (11) and at the same time contact is made with the line cores (3, 4) of the cable.

20 Claims, 5 Drawing Sheets

MODULE FOR THE CONNECTION OF ACTUATOR AND/OR SENSORS

Figure 1:
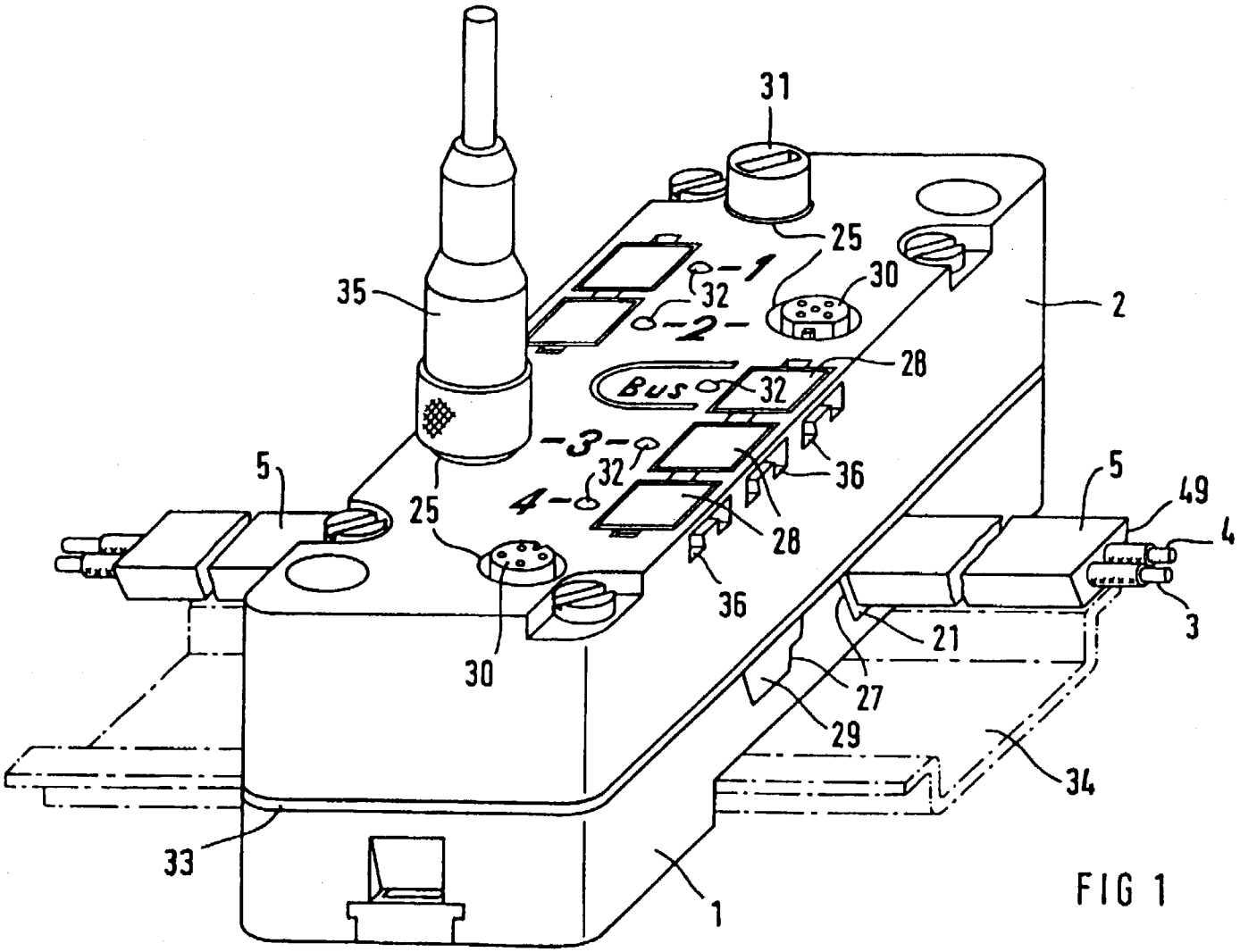

The invention relates to a module for the connection of actuators and/or sensors, having a housing and having a contact-making device which is accommodated in the housing and is used to make contact between line cores of a multicore cable and contacts which are connected to an electrical circuit of the module.

Modules of this type are already commercially available from various manufacturers, including the applicants themselves. The modules are implemented using plug-in technology. A further development of these modules has led to an improved bus module for the connection of a plurality of subscribers (actuators, sensors), which comprises a top part, complying with the requirements of the user, as a so-called user module, and a bottom part for contact-making. Since the cable is used as a bus line to which a multiplicity of modules are intended to be connected, the design of the module including its contact-making system is of particular significance.

The invention is based on the object of providing a module which has a simple structure and by means of which the cable can be made contact with in a simple, cost-effective and reliable manner. This object is achieved in accordance with the features as claimed in patent claim 1. In an advantageous development of the subject matter according to the invention there is provided in the housing a press-on surface which, when the housing is closed, presses the line basket, which is latched in the upper position, together with the inserted cable down into the lower position. This means that the line basket is automatically displaced into the lower position when the housing is closed, the line cores at the same time making contact with the contacts. Assembly is consequently simple and user-friendly.

The abovementioned latching of the line basket in two vertical positions is implemented in a particularly simple manner in accordance with the following embodiment. In the case of this embodiment, for the purpose of latching the line basket in its two positions, the guiding part has on its inside first longitudinal grooves and second longitudinal grooves which are offset in terms of height and length. The line basket is provided on its outside with first and second latching lugs which are matched to the first and second longitudinal grooves. In the upper position the line basket latches with its first latching lugs in the first longitudinal grooves. This latching is canceled in the event of displacement into the lower position with clamping action on the cable. In the lower position the line basket latches with its second latching lugs in the second longitudinal grooves. In the case of the embodiment described, a corresponding strain relief is produced on account of the clamping action on the cable in the lower position.

In accordance with a further advantageous development, the guiding part has in its longitudinal direction a center region and two end regions adjoining the latter on both sides. The second longitudinal grooves and the contact tips are arranged in the center region and the first longitudinal grooves are arranged in the end regions. The line basket has corresponding opposite subregions. The second latching lugs and the positioning means designed as snap-action hooks are arranged in the center region of said basket and the first latching lugs are arranged in a vertically offset manner in its end regions. The center and end regions of the line basket are separated from one another by slots which extend as far as the basket base and are directed transversely with respect to the longitudinal axis. This embodiment ensures not only that the line basket cannot be lifted out from its upper latched position, but also that it is locked in the longitudinal direction and hence is connected captively to the guiding part.

It is furthermore advantageous if contact is made between the line cores and the contacts by connecting a top-part housing to the bottom-part housing and if, in the process, a bulge in the form of a pressure post in a bottom-end cover of the top-part housing acts as a press-on surface. The cover which is required anyway is additionally used here for pressing onto the line basket and the cable.

In order to ensure that when the top-part housing and the bottom-part housing are assembled, they are seated on one another in the correct position, it is advantageous if differently designed coding lugs which fit into corresponding guides of the bottom-part housing are provided on the cover. It is furthermore advantageous if, for the purpose of connecting the actuators and/or sensors, plug-in and screw connections are provided in a distributed manner in the top-part housing, and plug threads associated with them are molded in, in such a way that straight and angled plugs can be connected, and if, in addition to the plug threads, plate recesses are present for snap-in name plates which are unambiguously assigned to the plug-in and screw connections. In this case, a plurality of plugs can be connected in close proximity without any mutual hindrance, there being provided at the same time, for each plug connection, a designation plate assigned unambiguously to the respective plug-in and screw connection.

In order to avoid inadvertently connecting actuators and sensors to plug-in and screw connections not intended therefor, the latter are coded differently.

A further advantageous development of the invention is that in accordance with claims 12 and 13. This enables the module to be used as an electrical junction, too, in that a two-core cable is truncated in the module and the second cable is passed through.

Figure 2:
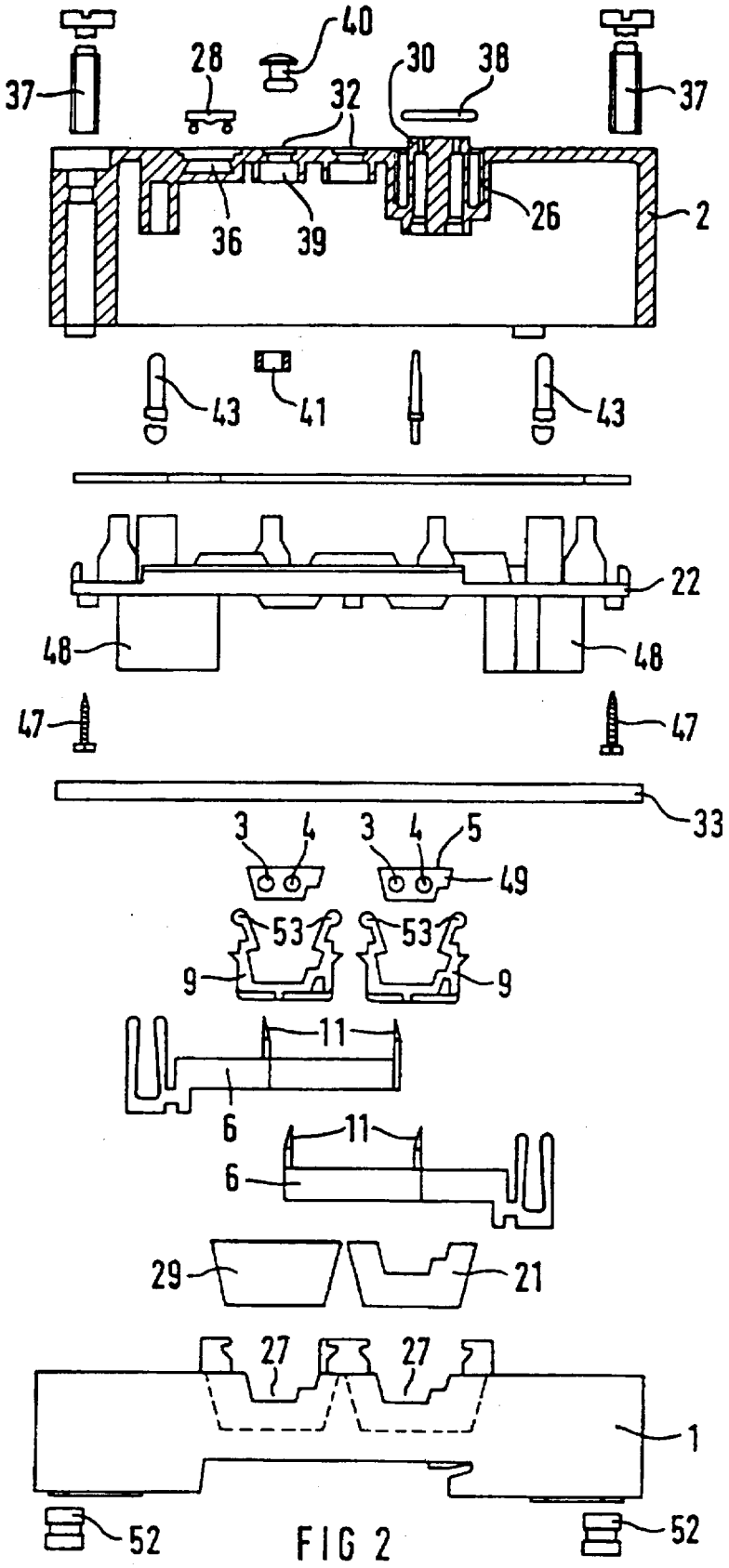
Figure 3:
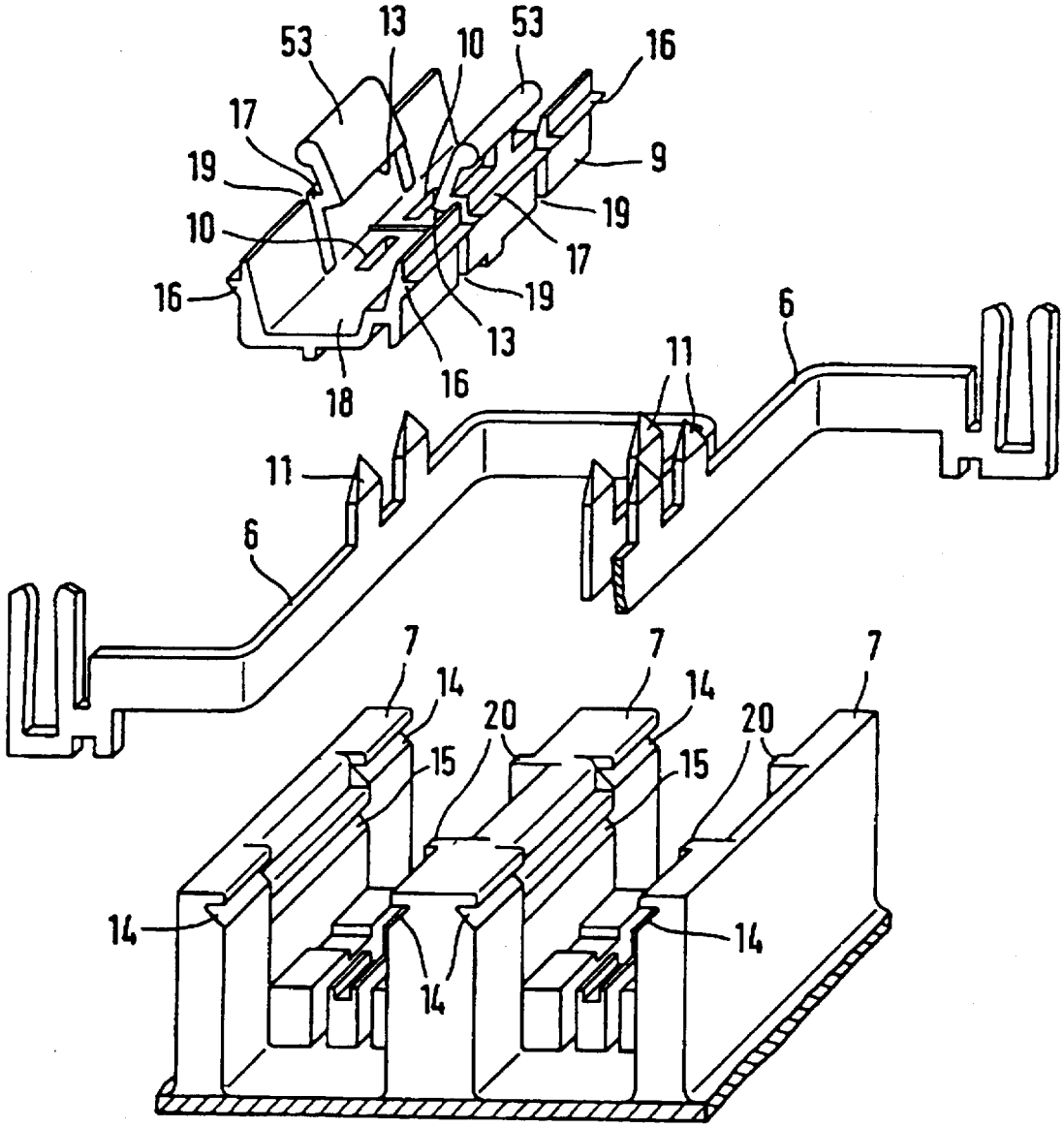
Figure 4:
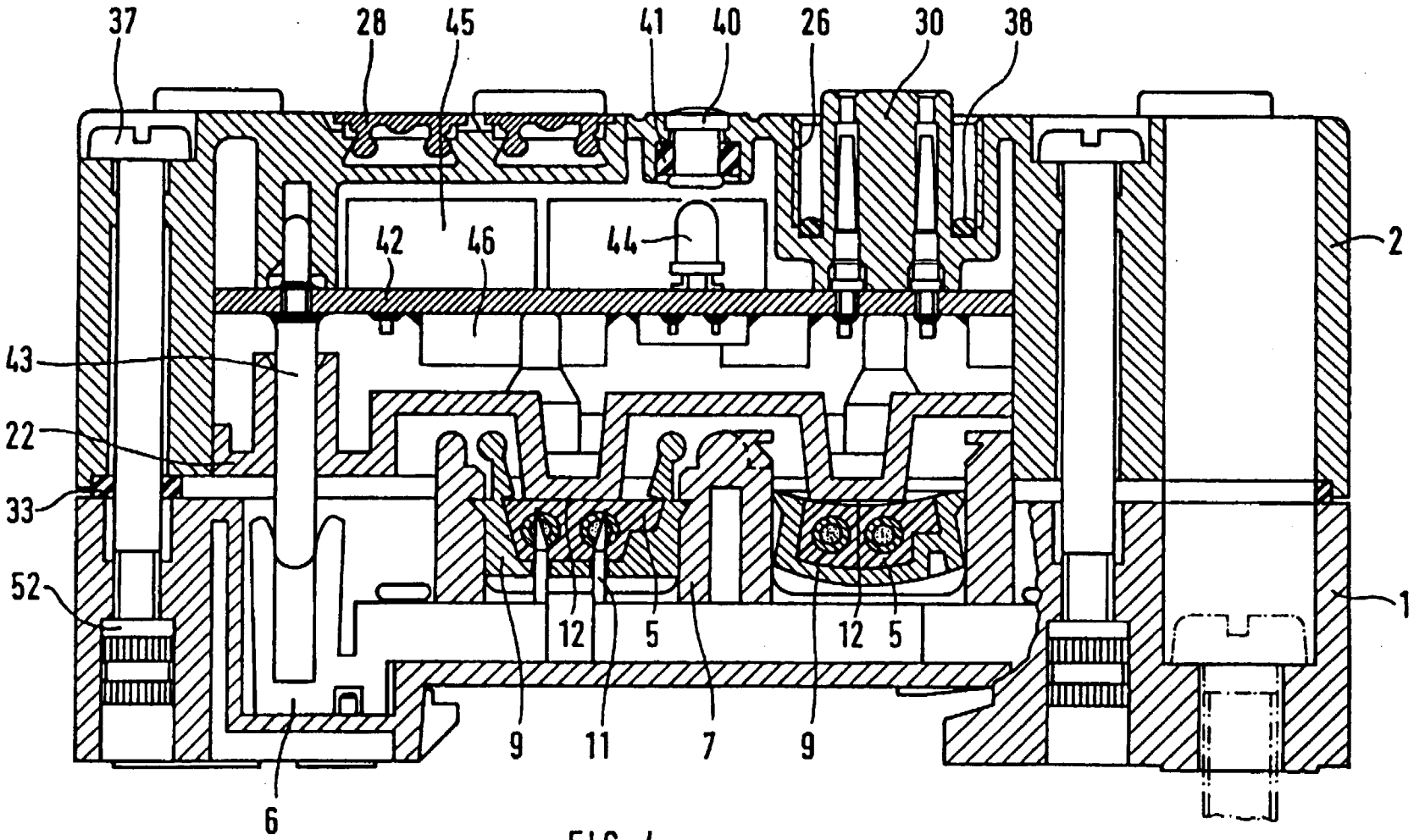
Figure 5:
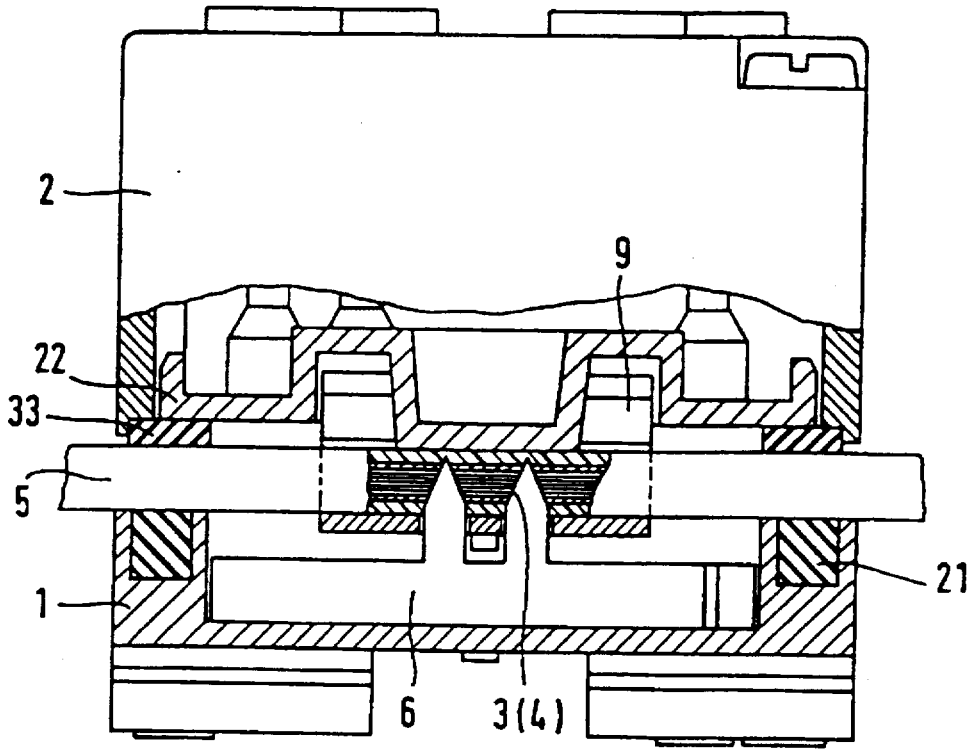
Figure 6:
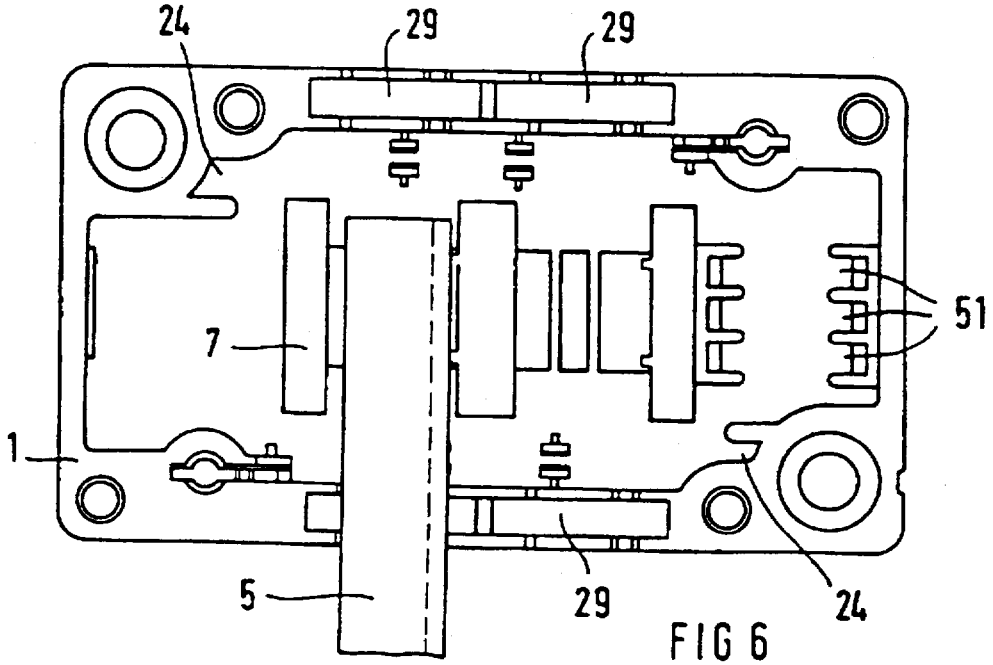

An embodiment of the invention is explained in more detail below with reference to a drawing, in which:

FIG. 1 shows a module according to the invention which is snapped onto a top-hat rail, FIG. 2 shows the module according to FIG. 1 in an exploded illustration, FIG. 3 shows a detailed view of a guiding part with contacts and an insertable line basket, FIG. 4 shows a longitudinal section through the module according to FIG. 1, FIG. 5 shows a cross section through the module according to FIG. 1, FIG. 6 shows a plan view of the bottom-part housing of the module.

The module according to the invention for the connection of actuators and/or sensors is, as FIG. 1 shows, composed of a bottom-part housing 1 and a top-part housing 2. There is situated in the bottom-part housing 1 a contact-making device for line cores 3,4 of two two-core, form-coded flat cables 5 to make contact with contacts 6 (see FIGS. 2,3,4) which are connected to an electrical circuit 8 arranged in the top-part housing 2. The form coding of the flat cables 5 used as a bus line is effected by a laterally molded-on profile strip 49.

In FIG. 1, the bottom-part housing 1 is attached to a top-hat rail 34 by being snapped on at the bottom. In order to accommodate the two form-coded flat cables 5, correspondingly form-coded housing recesses 27 are provided on the side of the bottom-part housing 1, in which recesses profile seals 21 are inserted at the very bottom to act as anti-kink means for the flat cables 5.

If contact is made with only one flat cable 5 in the module (see FIG. 1), then the unused housing recesses 27 are provided with filling elements 29.

The bottom-part housing 1 is screwed via a top-part seal 33 to the top-part housing 2, on the front face of which are arranged a total of four commercially available plug-in and screw connections 25 with coded plug domes 30 for the connection of subscribers (actuators and/or sensors). In this case, the plug domes 30 for the actuators have an outer coding and those for the sensors have an inner coding. Two plug-in and screw connections 25 are provided in each case, at a sufficient distance from one another, on each long side of the rectangular front of the top-part housing 2, those connections of one long side being offset with respect to those of the other long side. In addition, designation plates 28 assigned unambiguously to the plug-in and screw connections 25 are arranged in trapezoidal plate recesses 36, and a numerical identification is also provided.

The four subscriber outgoing connections 25, which are designed as plug-in and screw connections, are arranged in such a way that it is possible to connect straight and angled plugs 35 having molded-on lines, and also plugs having freely accessible terminals. The plug threads 26 (not visible here, see FIGS. 2,4) belonging to the plug-in and screw connections 25 are molded into the top-part housing 2. Unused subscriber connections 25 can be covered by screw caps 31.

In addition to the four designation plates 28 for the subscriber connections 25, a further designation plate 28, which is marked with the inscription "bus", is fitted in the center. Here, too, the assignment to the flat cable 5 which is designated here as bus is unambiguous. Holes 32 next to the designation plates 28 are used for the optical indication of the operating state of the components 25,5 in question.

FIG. 2 shows an exploded illustration of the module, the components of which are presented from top to bottom in accordance with the illustration. Reference is made to FIGS. 3,4 for the interconnection of the components.

Captively screwed-in housing screws 37 for screwing to the bottom-part housing 1 belong to the top-part housing 2 having the four plug-in and screw connections 25 and plate recesses 36 arranged on the front face. The tightness of the plug-in and screw connections 25 is achieved by means of O-rings 38 on the bottom of the plug threads 26 and together with the plug 35 (see FIG 1) includes the entire plug space. Cutouts 39, which are used to accommodate light guides 40 having associated rubber seals 41, adjoin the holes 32 in the top-part housing 2. The light guides 40 transmit the light from light-emitting diodes 44 (see FIG 4) belonging to the electrical circuit 8 to the surface of the top-part housing 2. Each subscriber outgoing connection 25 has a yellow indicator and, in order to differentiate from this, the activated bus line 5 has a green indicator. The light guides 40 are let into the top-part housing 2 with a collar and cannot be pressed in any more deeply by hand. A bead on the stem of the light guide 40 snaps behind the rubber seal 41 and prevents the light guide 40 from moving out of the top-part housing 2 in the opposite direction.

The abovementioned electrical circuit 8 is essentially implemented on a printed circuit board 42, into which are soldered two offset contact pins 43 which, on the one hand, hold fast in the top-part housing 2 and, on the other hand, plunge into the contacts 6 of the bottom-part housing 1 and hence carry the potential of the bus line 5 to the printed circuit board 42. The latter is populated with the light-emitting diodes 44, with relays 45 which are arranged on the edge in a space-saving manner, and with SMD components 46 (see FIG. 4). The printed circuit board 42 is held by a cover 22 which is pressed into the top-part housing 2 at the bottom end and is supported via the printed circuit board 42 on the plug domes 30 of the subscriber connections 25. The fastening is carried out using two self-tapping screws 47. Supporting the printed circuit board on the plug domes 30 saves space and permits optimum utilization of the printed circuit board 42 in respect of population area. The four supporting points through the plug domes 30 also absorb the forces exerted on the top-part housing 2 when the bus lines 5 are pressed into the contacts 6 of the module.

The cover 22 performs a plurality of tasks. It covers the printed circuit board 42 to prevent it from being touched by the hand, it transmits the contact-making forces and it accommodates the top-part seal 33 and fixes it by means of the four plug domes 30. In addition, the cover 22 ensures that the top-part housing 2 is placed onto the bottom-part housing 1 in the correct position. For this purpose, different coding lugs 48 are present on both ends of the cover 22, which lugs fit into corresponding guides 24 of the bottom-part housing 1 (see FIG. 6).

The distance between the cover 22 and the printed circuit board 42 is matched to the maximum dimension which is customary in the case of SMD components.

The top-part seal 33 which is held by domes of the cover 22 is inserted on the top-part housing 2.

The bus lines 5 having two line cores 3,4 for connection to different polarities make contact with the contacts 6 by means of the contact-making device. Line baskets 9 which can be latched in a guiding part 7 (see FIGS. 3,4,5) belong to the contact-making device. The guiding part 7 is situated in the center of the base of the bottom-part housing 1. The already mentioned, profiled housing recesses 27 are incorporated on the upper edge of the long sides of the bottom-part housing 1 in order to accommodate the bus lines 5, into which recesses the profile seals 21 are inserted before the bus lines 5 are inserted. The screwing to the top-part housing 2 takes place by means of the housing screws 37 which have matching threaded bushes 52 in the bottom-part housing 1.

FIG. 3 illustrates the contact-making device which essentially comprises the guiding part 7, the contacts 6 and line baskets 9. The guiding part 7 has two recesses in the form of channels in which one line basket 9 each can be latched in an upper and a lower position.

The contacts 6 are stamped from a strip and bent. During assembly of the module, the contact pins 43 plunge into that end of the contacts which is forked and carry the potential of the bus line 5 to the printed circuit board 42. Contact tips 11 for making contact between the two bus lines 5 are arranged in the center and at the end of the contacts 6. The contacts 6 are held, with their contact tips 11 directed toward the channel opening, in the center of the base of the two recesses in the form of channels in the guiding part 7.

For the purpose of latching the line basket 9 in the two positions, the guiding part 7 has on its inside first longitudinal grooves 14 arranged in the end regions and second longitudinal grooves 15 arranged in the center region, all of which grooves are offset in terms of height and length. Each recess in the form of a channel is provided on one inner side with a web 20 which lies transversely with respect to the longitudinal axis.

The line basket 9 has an inner profile which is matched to the form-coded bus line 5, with the result that a bus line 5 inserted herein is gripped in a positively locking manner. First 16 and second 17 latching lugs which are matched to the first 14 and second 15 longitudinal grooves are correspondingly arranged on the outer sides of the line basket 9.

When the line basket 9 is inserted into the guiding part 7, the first longitudinal grooves 14 and the first latching lugs 16 latch together in an upper preassembly position. In this position, the bus line 5 is inserted into the line basket 9 and in the process held by means of inwardly projecting snap-action hooks 13. By pressing on further, the line basket 9 can be displaced into the lower position in which the two latching lugs 17 latch in the second longitudinal grooves 15 and in which the contact tips 11 project through slots 10 on the bottom end. This means that the contact tips 11 penetrate the insulation of the bus line 5 when the line basket 9 together with said bus line is lowered, and bore into the line cores 3,4 which are designed as stranded wires.

The webs 20 which are situated on the inside in the guiding part 7 move into the slots 19 of the line basket 9 which extend as far as the base 18 thereof and likewise subdivide the line basket 9, on the longitudinal side, into two end regions and a center region with the first 16 and second 17 latching lugs situated there. Using lips 53 which are molded on in the center region, it is possible to cancel the latching in the lower position of the line basket 9 by means of a screwdriver, and this permits displacement into the upper position. However, longitudinal displacement of the line basket 9 is precluded as a result of the engagement of the webs 20 of the guiding part 7 into the slots 19 of the line basket 9.

FIG. 4 shows a longitudinal section through the inventive module whose structure has already largely been explained in the preceding descriptions of the figures (FIGS. 1, 2, 3). Therefore, only the contact-making system will be discussed at this point. To this end, FIG. 4 illustrates the position of the line basket 9 and its interaction with bus lines 5 which have been brought into contact. The section, illustrated here, through the left-hand bus line 5 refers to the center region of the guiding part 7 and of the line basket 9. The second latching lugs 17 latch into place here in the deep-seated second longitudinal grooves 15, and the line basket 9 encloses the form-coded bus line 5 by means of its snap-action hooks 13. The contacts 6 arranged under the line basket 9 penetrate the insulation of the bus line 5 by means of their contact tips 11 and penetrate the stranded wires 3,4. The bulge 12 in the form of a pressure post in the cover 22 is used as a press-on surface which acts on the top of the bus line 5. After removing the top-part housing 2 with the cover 22, the line basket 9 and bus line 5 remain in the illustrated position. A screwdriver can be used to unlatch the line basket by means of the lips 53 thereof which are molded on at the top. The bus line 5 on the right-hand side is shown in section through one of the end regions of the guiding part 7 and of the line basket 9. Here are arranged the first longitudinal grooves 14 which are higher than the second longitudinal grooves 15 which are situated in the center region. As in the center region, the bus line 5 is likewise situated in a positively locking manner in the line basket 9. The outer first latching lugs 16 of the latter are not latched, but rest on the inside against the guiding part 7 and thus press together the end region of the line basket 9 and the bus line 5. The bulge 12 in the form of a pressure post in the cover 22 also presses here on said line. These measures produce the desired strain relief of the bus line 5.

FIG. 5 shows a cross section of, in particular, the contact-making device of the module. The contact 6 arranged at the bottom in the bottom-part housing 1 penetrates, by means of its two contact tips 11, the insulation of the bus line 5 which is inserted into the line basket, is pressed down in a latching manner into the lower position by the bulge 12 in the form of a pressure post in the cover 22 and is held in that position. The bottom-part housing 1 has at the sides the housing recesses 27 into which are inserted profile seals 21 as a support for the bus line 5.

FIG. 6 shows a plan view of the bottom-part housing 1 with a truncated bus line 5 which has been inserted into the left-hand guiding part 7 with the line basket 9. It is possible to supply the electrical circuit 8 and communicate with the subscribers to be connected solely via this line. However, there is a fundamental requirement to connect a plurality of modules to the bus line 5, for which purpose the bus line 5 is routed through the modules. For redundancy reasons, it is expedient to provide two bus lines 5. The two are electrically interconnected in terms of polarity via the contacts 6 with their contact tips 11 in the state in which contact has been made. Consequently, it is also possible to use the modules as electrical junctions with a truncated bus line and with a continuous bus line in the module.

In addition to the guiding part 7, three pockets 51 in which unused filling elements 29 and profile seals 21 may be stored are present in the bottom-part housing 1.

Guides 24 which can be seen in FIG. 6 are situated in the bottom-part housing 1 in a manner fitting the differently configured coding lugs 48 in the cover 22 (see FIG. 2) of the top-part housing 2. This ensures the positionally correct assembly of the housing 1, 2 in a simple manner.

I claim:

1. A module for the connection of subscribers to a multicore cable having line cores enclosed by insulation, the cable having a form coding which indicates the position of the line cores, comprising:

1. a housing;
2. an electrical circuit having contacts disposed with in said housing;
3. a contact-making device disposed in said housing and adapted to make contact between the line cores of the multicore cable and said contacts of said electrical circuit, said contact-making device including:
   1. a guiding part in the form of a channel;
   2. a line basket which can be latched therein in two vertical positions, said line basket having an inner profile corresponding to the form coding of the cable and openings in its base, said line basket having positioning means to hold an inserted cable in position; and
   3. contacts, arranged under the line basket, having contact tips directed toward said openings, whereby, in an upper position of the two positions, said cable can be inserted, when the housing of the module is open, into the line basket in a position which is predetermined by the form coding in conjunction with the inner profile and held in place by said positioning means, and that only when the line basket is pressed down into a lower position of the two positions do said contact tips project upward through the openings and at the same time make contact with the line cores while penetrating the cable insulation.

2. The module as claimed in claim 1, and further including a pressure surface in said housing, said surface positioned such that, when the housing is closed, said surface presses said line basket, latched in the upper position, together with the inserted cable down into the lower position.

3. The module as claimed in claim 2, wherein said guiding part has first longitudinal grooves and second longitudinal grooves on its inside, said grooves being offset in terms of height and length, and wherein said line basket has first and second latching lugs on its outside, first and second latching lugs being matched to said first and second longitudinal grooves, whereby, in the upper position the line basket latches with its first latching lugs in the first longitudinal grooves, this latching being released in the event of displacement into the lower position with clamping action on the cable, and whereby, in the lower position the line basket latches with its second latching lugs in the second longitudinal grooves.

4. The module as claimed in claim 3, and further including means for releasing the latching only from the lower position.

5. The module as claimed in claim 4, wherein:

1. said guiding part has, in its longitudinal dimension, a center region and two end regions adjoining said center region on both sides;
2. said second longitudinal grooves and said contact tips are disposed in the center region and said first longitudinal grooves are arranged in the end regions;
3. said line basket has corresponding opposing center and end subregions;
4. said second latching lugs and said positioning means are arranged in the center region of said basket; and
5. said first latching lugs are arranged in a vertically offset manner in the two end regions of said basket, and further including:
6. slots which extend as far as the basket base and are directed transversely with respect to the longitudinal axis separating the center and end regions of the line basket.

6. The module as claimed in claim 1, wherein said positioning means comprise snap-action hooks.

7. The module as claimed in claim 5, wherein said guiding part has at least one web engaging into one of said slots in said basket.

8. The module as claimed in claim 1, wherein:

1. said housing includes a bottom housing part in which said contact-making device is disposed, said bottom housing part having opposed profiled housing recesses in its sides acting as extensions of the contact-making device; and further including:
2. profile seals for receiving said cable inserted in said recesses.

9. The module as claimed in claim 8, wherein said housing further includes a top housing part having a bottom-end cover in which is formed a bulge in the form of a pressure post, whereby when said top housing part is connected to said bottom housing part contact is made between the line cores and the contacts as a result of said bulge pressing against said cable.

10. The module as claimed in claim 1, and further including differently designed coding lugs formed in said cover and corresponding guides formed in the bottom housing part into which said coding lugs fit.

11. The module as claimed in claim 1, and further including:

1. plug-in and screw connections distributed in said top housing part, said connections having associated therewith plug threads molded in said housing such as to permit straight and angled plugs to be connected; and
2. plate recesses for receiving snap-in designation plates which are unambiguously assigned to the plug-in and screw connections, whereby actuators and/or sensors can be connected to said module.

12. The module as claimed in claim 11, wherein different ones of said plug-in and screw connections are coded differently.

13. The module as claimed in claim 11, and further including:

1. at least one further cable; and
2. a further guiding part and line basket with associated contacts.

14. The module as claimed in claim 13, wherein:

1. two two-core cables each having one line core for connection to positive polarity and the other to negative polarity can be connected to said module;
2. said contacts comprise two rails having contact tips at the points provided for contact-making and situated underneath the line baskets; and
3. the line cores for connection to the positive polarity and the line cores for connection to the negative polarity are respectively electrically interconnected by means of one of the rails in the state in which contact has been made.

15. A module for the connection of circuits to multicore cables in combination with two multicore cables each having two line cores enclosed by insulation, each cable having one line core for connection to positive polarity and the other to negative polarity, the cables having a form coding which indicates the position of the line cores, comprising:

1. a housing;
2. an electrical circuit having contacts disposed in said housing;
3. a contact-making device disposed in said housing and adapted to make contact between the line cores of the multicore cable and said contacts of said electrical circuit, said contact-making device including:
   1. a guiding part in the form of a channel;
   2. a line basket which can be latched therein in two vertical positions, said line basket having an inner profile corresponding to the form coding of the cable and openings in its base, said line basket having positioning means to hold an inserted cable in position; and
   3. contacts, arranged under the line basket, comprising two rails having contact tips directed toward said openings at the points provided for contact-making and situated underneath the line baskets, whereby, in an upper position of the two positions, said cable can be inserted, when the housing of the module is open, into the line basket in a position which is predetermined by the form coding in conjunction with the inner profile and held in place by said positioning means, and that only when the line basket is pressed down into a lower position of the two positions do said contact tips project upward through the openings and at the same time make contact with the line cores while penetrating the cable insulation the line cores for connection to the positive polarity and the line cores for connection to the negative polarity are respectively electrically interconnected by means of one of the rails in said state in which contact has been made.

16. A module for the connection of circuits to a multicore cable having line cores enclosed by insulation, the cable having a form coding which indicates the position of the line cores, comprising:

1. a housing;
2. an electrical circuit having contacts;
3. a contact-making device disposed in said housing and adapted to make contact between the line cores of the multicore cable and said contacts of said electrical circuit, said contact-making device including:

1. a guiding part in the form of a channel said guiding part having, in its longitudinal dimension, a center region and two end regions adjoining the center region on both sides;
   (1) first longitudinal grooves disposed in the end regions and second longitudinal grooves disposed in the center region; and
2. a line basket which can be latched in said guiding part in two vertical positions, said line basket having an inner profile corresponding to the form coding of the cable and having openings in its base, said line basket having:
   (1) positioning means to hold an inserted cable in position;
   (2) corresponding center and end subregions opposing those of said guiding part;
   (3) first latching lugs are arranged in a vertically offset manner in the two end regions of said basket;
   (4) second latching lugs and said positioning means arranged in the center region of said basket; and
   (5) slots which extend as far as the basket base and are directed transversely with respect to the longitudinal axis separating the center and end regions of the line basket; and
3. contacts, arranged under the line basket, having contact tips directed toward said openings, whereby, in an upper position of the two positions, said cable can be inserted, when the housing of the module is open, into the line basket in a position which is predetermined by the form coding in conjunction with the inner profile and held in place by said positioning said positioning means, and that only when the line basket is pressed down into a lower position of the two positions do said contact tips project upward through the openings and at the same time make contact with the line cores while penetrating the cable insulation.

17. The module as claimed in claim 16, wherein:

1. said housing includes a bottom housing part in which said contact-making device is disposed, said bottom housing part having opposed profiled housing recesses in its sides acting as extensions of the contact-making device; and further including:
2. profile seals for receiving said cable inserted in said recesses.

18. The module as claimed in claim 17, wherein said housing further includes a top housing part having a bottom-end cover in which is formed a bulge in the form of a pressure post, whereby when said top housing part is connected to said bottom housing part contact is made between the line cores and the contacts as a result of said bulge pressing against said cable.

19. The module as claimed in claim 18, and further including differently designed coding lugs formed in said cover and corresponding guides formed in the bottom housing part into which said coding lugs fit.

20. The module as claimed in claim 18, and further including:

1. plug-in and screw connections distributed in said top housing part, said connections having associated therewith plug threads molded in said housing, such as to permit straight and angled plugs to be connected; and
2. plate recesses for receiving snap-in designation plates which are unambiguously assigned to the plug-pin and screw connections, whereby actuators and/or sensors can be connected to said module.

* * * * *